United States Patent [19]

Harbert

[11] Patent Number: 5,022,877

[45] Date of Patent: Jun. 11, 1991

[54] MARINE EXHAUST SYSTEM

[75] Inventor: Earl W. Harbert, Coral Springs, Fla.

[73] Assignee: Vernay Laboratories, Inc., Yellow Springs, Ohio

[21] Appl. No.: 481,073

[22] Filed: Feb. 16, 1990

[51] Int. Cl.[5] ..... B63H 21/32

[52] U.S. Cl. ..... 440/89; 60/324; 181/215

[58] Field of Search ..... 440/88, 89; 60/290, 60/309, 310, 324, 39.2; 181/212, 213, 215, 220, 221, 235, 249, 259, 260; 123/323

[56] References Cited

U.S. PATENT DOCUMENTS

| | | | |
|---|---|---|---|
| 1,816,371 | 7/1931 | Hefti | 440/89 |
| 1,892,853 | 1/1933 | Rustin et al. | 181/260 |
| 2,204,294 | 6/1940 | Blanchard | 181/260 |
| 2,923,127 | 2/1960 | Biehl et al. | 60/39.2 |
| 2,931,169 | 4/1960 | Glenn | 60/39.32 |
| 3,176,791 | 4/1965 | Betts et al. | 181/260 |
| 3,296,997 | 1/1967 | Hoiby et al. | 440/89 |
| 3,371,645 | 3/1968 | Ward | 55/267 |
| 3,553,944 | 1/1971 | Hum et al. | 440/89 |
| 4,019,456 | 4/1977 | Harbert | 440/89 |

*Primary Examiner*—Jesus D. Sotelo

*Attorney, Agent, or Firm*—Biebel, French & Nauman

[57] ABSTRACT

A marine exhaust system is provided for separating the gas from the water of gas/water mixture produced by a marine engine, and expelling the gas a sufficient distance from the hull of a boat to place it outside of the turbulent boundary layer surrounding the hull and the low pressure area following behind the boat. A nozzle having a variable outlet area is mounted amidship on the hull for maintaining a predetermined pressure within the exhaust system in order to expel the gases a maximum distance from the boat. In addition, apparatus are provided for removing the water from the exhaust system prior to the gases reaching an acoustical chamber for attenuating exhaust gas noises.

28 Claims, 7 Drawing Sheets

VENT VALVE
CHARGE VALVE
IGNITION
NEUTRAL SAFETY SWITCH

MARINE EXHAUST SYSTEM

BACKGROUND OF THE INVENTION

The present invention generally relates to exhaust systems and more particularly to a marine exhaust system which expels exhaust gas to a point outside of the turbulent boundary layer surrounding the moving hull of a boat.

Engine powered boats, such as sport fishing type boats and cruise boats, suffer from a problem resulting from the low pressure area created behind the boat and the associated turbulent boundary layer extending along the sides of the boat. Exhaust gases which are typically expelled either to the rear of the boat or from the side are trapped within the low pressure area behind the boat and may recirculate up to the passenger compartment or cabin of the boat.

Attempts to solve the above problem include the exhaust system described in U.S. Pat. No. 4,019,456 to Harbert. In this system a gas/water mixture is fed to a muffler which first uses the water to attenuate the exhaust noise and then separates the water from the exhaust gas. The water is then expelled from the boat through an exit in the rear of the hull and the gas is passed through a chamber which accelerates it before it is expelled from the boat through an outlet nozzle located in the hullside near the transom. This design suffers from the problem that the nozzle has a fixed outlet area and thus must be designed to be most efficient at the average cruising speed of the engine. When the engine is operated at full throttle speeds, the exhaust back pressure is excessive for the engine. In addition, when the boat is operated at trolling speeds or low engine speeds, the exhaust gases are not expelled far enough from the boat hull to project them outside the effect of the low pressure area behind the boat or the turbulent boundary layer surrounding the hull.

Although one embodiment of the Harbert patent contemplates providing a spring valve 148 which opens to permit passage of additional gas and prevent excessive build up of back pressure in the system, this solution suffers from the problem of the valve being noisy as it flaps open and closed due to the rapid pulsations of the columns of exhaust gases that is typical of reciprocating engines. In addition, the spring valve does not provide controlled expulsion of gases to maximize the velocity of the gases as they leave the nozzle in order to project them outside of the turbulent boundary layer.

Furthermore, since the Harbert muffler design depends on water to attenuate the exhaust noises, the effectiveness of the muffler will vary depending upon the quantity of water within the muffler at any given time. The quantity of water changes with engine speed and thus its effectiveness at attenuating the exhaust noises is limited.

Accordingly, there is a need for a marine exhaust system which will effectively project exhaust gases through or outside of the turbulent boundary layer surrounding a boat hull for any given engine or boat speed.

In addition, there is a need for an exhaust assembly which will effectively separate exhaust gases from water and efficiently attenuate exhaust noises for all operating conditions.

SUMMARY OF THE INVENTION

The present invention provides a marine exhaust system having a nozzle for projecting exhaust gases a maximum distance from a boat hull for any given engine speed, and means for separating the water and gas components in a gas/water mixture prior to conveying the gas through a sound attenuation chamber for reducing the exhaust noises.

In a preferred embodiment, a mixture of exhaust gas and cooling water is conveyed from a marine engine through an exhaust pipe to an enlarged pipe to slow the flow of the gas/water mixture, such that the heavier water will separate from the gas and settle to a lower portion of the enlarged pipe to provide an initial separation of water from the exhaust gases.

The gas/water mixture is then conveyed to a first chamber for separating the water from the gases and the water is drained out through a water discharge pipe leading through the hull of the boat. The exhaust gases are conveyed from the first chamber to a second chamber having sound baffling means for attenuating the exhaust noises, and then to a nozzle having a variable outlet area located in the side of the boat hull.

Water which condenses out of the gas within the second chamber is discharged into the water discharge pipe and is conveyed with the water from the first chamber to a water outlet in the bottom of the hull of the boat. The water outlet is covered by a reverse scoop having an opening facing away from the direction of the water flow when the boat is moving in a forward direction, such that a suction effect is created to assist gravity and internal system pressure in expelling the water from the discharge pipe. Also in the preferred embodiment, the first chamber is provided with a vertical tube having an opening near a top portion of the first chamber providing an exit for gases after they have been separated from the water in the gas/water mixture. The gases entering the vertical tube are then conveyed to a centrally located, perforated tube within the second chamber which works in conjunction with at least one other perforated tube for attenuating the exhaust noise as the gas passes through the tubes.

The nozzle is provided with a flexible orifice means for varying the outlet area of the nozzle, and control means located on top and bottom portions of the flexible orifice means control the opening of the nozzle. The control means are acted upon by actuator means located remotely from the nozzle.

The actuator means may be in the form of a mechanical linkage to the throttle control system for the boat's engine, or in the form of an electromechanical drive means connected to sensors for sensing the engine speed and the exhaust system pressure. In either case, the actuator means acts on the control means to provide a large nozzle outlet area at high engine speeds and to smoothly continuously close down the nozzle area as the engine speed is decreased.

Thus, the exhaust system pressure may be increased at low engine speeds to project the exhaust gases further from the boat hull, and the nozzle outlet area may be increased as the engine speed increases to prevent excessive pressure build-up within the exhaust system. In this manner the exhaust system pressure may be maintained at or below the maximum pressure recommended by the engine manufacturer and thus, the distance to which the gases may be expelled from the boat hull is maximized.

Other objects and advantages of the invention will be apparent from the following description, the accompanying drawings, and the appended claims.

DETAILED DESCRIPTION OF THE PREFERRED EMBODIMENT

Figures 1, 2A:
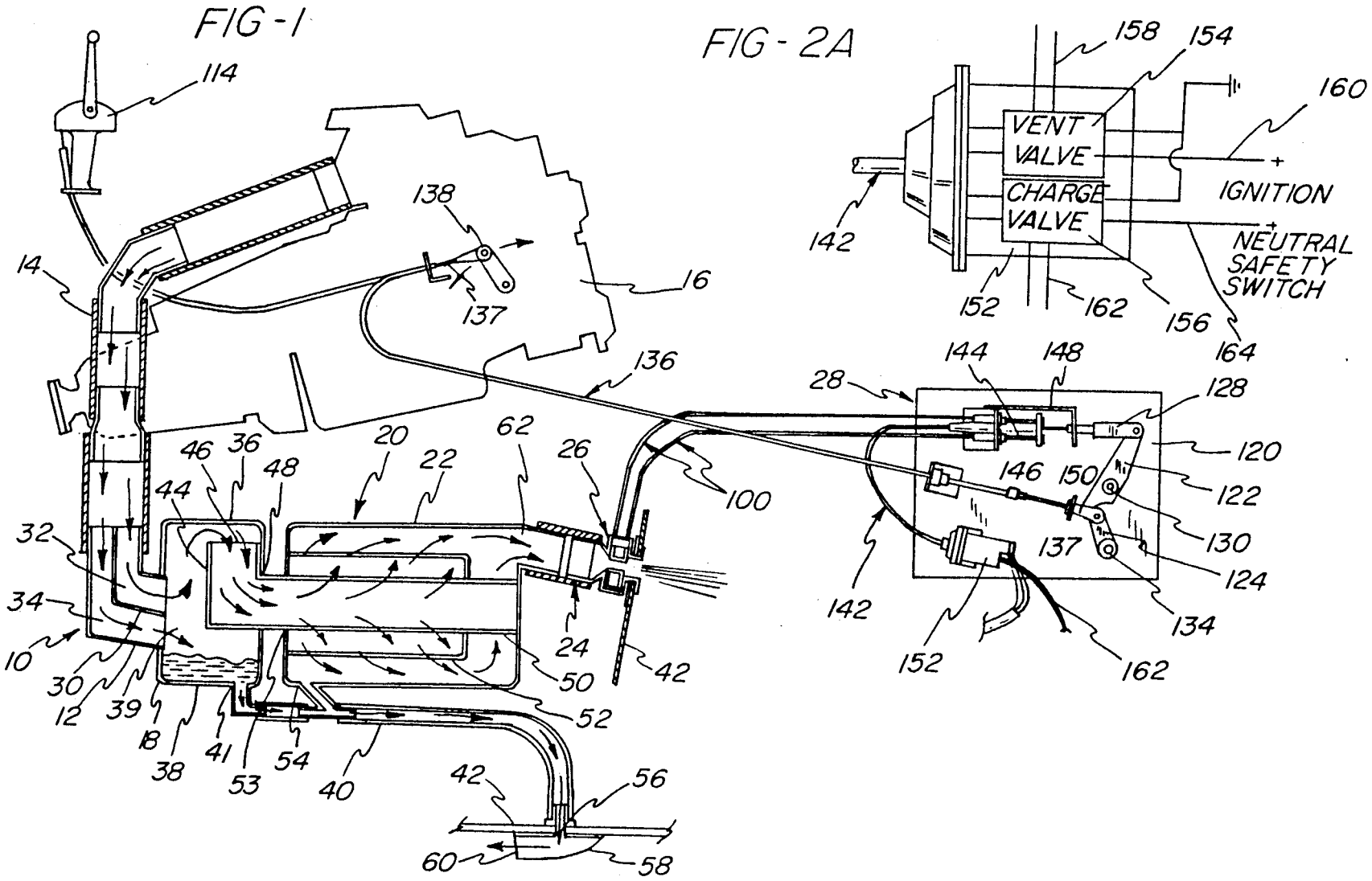
FIG. 1 is a schematic of the present exhaust system showing a mechanical linkage actuator.
FIG. 2A is a schematic view of the connecting means actuator for the mechanical linkage actuator shown in FIGS. 1 and 2.

Referring to FIG. 1, it can be seen that the exhaust system 10 of the present invention includes an expansion pipe 12 connected to the exhaust pipe 14 of a marine engine 16 for receiving a gas/water mixture from the engine 16. The expansion pipe 12 provides an initial separation of the water from the gas and conveys them to a first chamber 18 of an exhaust assembly 20 which further separates the water from the gas and conveys the water away from the boat. The gas passes from the first chamber to a second chamber 22 of the exhaust assembly 20 which has baffling means for attenuating the exhaust noise. The exhaust gases then pass from the second chamber 22 to a nozzle 24 which has a variable outlet area which is controlled by control means 26 connected to actuator means 28 which are remotely located from the nozzle 24.

The expansion pipe 12 is formed of a larger diameter than the exhaust pipe 14 coming from the engine 16 such that the expansion pipe 12 slows the velocity of the gas/water mixture and allows the heavier liquid to settle to the bottom of the pipe 12 and thereby provides an initial stage of water separation.

The expansion pipe 12 is oriented substantially horizontally with a slight downward slope from the engine exhaust pipe 14 to the first chamber 18. The expansion pipe 12 includes a baffle 30 which is also oriented substantially horizontally and which divides the expansion pipe 12 into approximately equal upper and lower portions 32, 34. The baffle 30 serves to provide an initial separation of a gas/water mixture coming from the engine 16 such that water flows through the lower portion 34 of the expansion pipe 12 and gases pass through the upper portion 32.

The exhaust gases and water are conveyed from the expansion pipe 12 to a first chamber 18 designed to provide for maximum water removal from the exhaust gases. The first chamber 18 is provided with a top wall 36 and a bottom wall 38 and an entrance 39 between the top and bottom walls 36, 38 for receiving the gas and water from the expansion pipe 12.

Water collects along the bottom of the first chamber 18 and is conveyed away from the chamber 18 by means of a water discharge pipe 40 connected to an exit 41 in the bottom wall 38 of the chamber 18. The discharge pipe 40 is further connected to the bottom of the hull 42 of the boat for discharging the water away from the boat.

The first chamber 18 further includes a vertical tube 44 having an upper end 46 adjacent the top wall 36 and a lower end connected to a gas exit 48 in a wall of the first chamber 18 between the top and bottom walls 36, 38. The upper end 46 of the tube 44 receives gases which have been separated from the water coming from the engine exhaust pipe 14 and expansion pipe 12 and provides an effectively complete separation of the gas from the water which collects in the bottom of the chamber 18.

The gases exiting the first chamber 18 are conveyed to a second chamber 22 which acts as a acoustical chamber to attenuate the exhaust gas noises. The second chamber 22 is formed as an elongated chamber within which are located a plurality of perforated sound baffling tubes 50, 52, one of the tubes 50 being substantially centrally located within the second chamber. The tube 50 is connected to a substantially centrally located entrance 53 to the second chamber 22 for receiving gases from the first chamber 18 and extends the full length of the second chamber 22. The exhaust gases pass through at least one other perforated tube 52 to further attenuate the exhaust gas noises, and the tube 52 may be positioned such that it concentrically surrounds the centrally located tube 50. In addition, a water exit 54 is provided for removing water which condenses out of the gases within the second chamber 22 and is located at a lower portion of the second chamber 22, exteriorly of the sound baffling tubes 50, 52.

The water exit 54 of the second chamber 22 is connected to the water discharge pipe 40 running from the first chamber 18 for conveying water to an outlet 56 in the bottom of the boat's hull 42. The outlet 56 in the hull bottom 56 is covered by a reverse scoop 58 having an opening 60 facing away from the direction of water flow as it would move over a boat's hull 42 when the boat is moving in a forward direction. Thus, the water flow over the scoop 58 will create a scarfing or suction action on the water within the discharge pipe 40 and thus improve water removal from the first and second chambers 18, 22.

As a result of not using water within the second chamber 22 to reduce the exhaust noises, the amount of sound reduction is maintained at a consistent level without the variations which result from relying on water which is present in a wet exhaust attenuation system in varying amounts depending upon operating conditions within the system. Furthermore, by designing the second chamber 22 to only handle gases, which have more predictable flow characteristics than a gas/water mixture, the baffling means within the second chamber 22 can be designed for the most efficient fluid flow through the chamber 22.

After the gases within the second chamber 22 have passed through the perforated tubes 50, 52, they are conveyed through an outlet 62 located in an upper portion of the second chamber 22 to a nozzle 24. The nozzle 24 is located adjacent to and above the loaded water line and amidship on the boat hull 42, and is directed at a slight downward angle toward the water.

Figure 4:
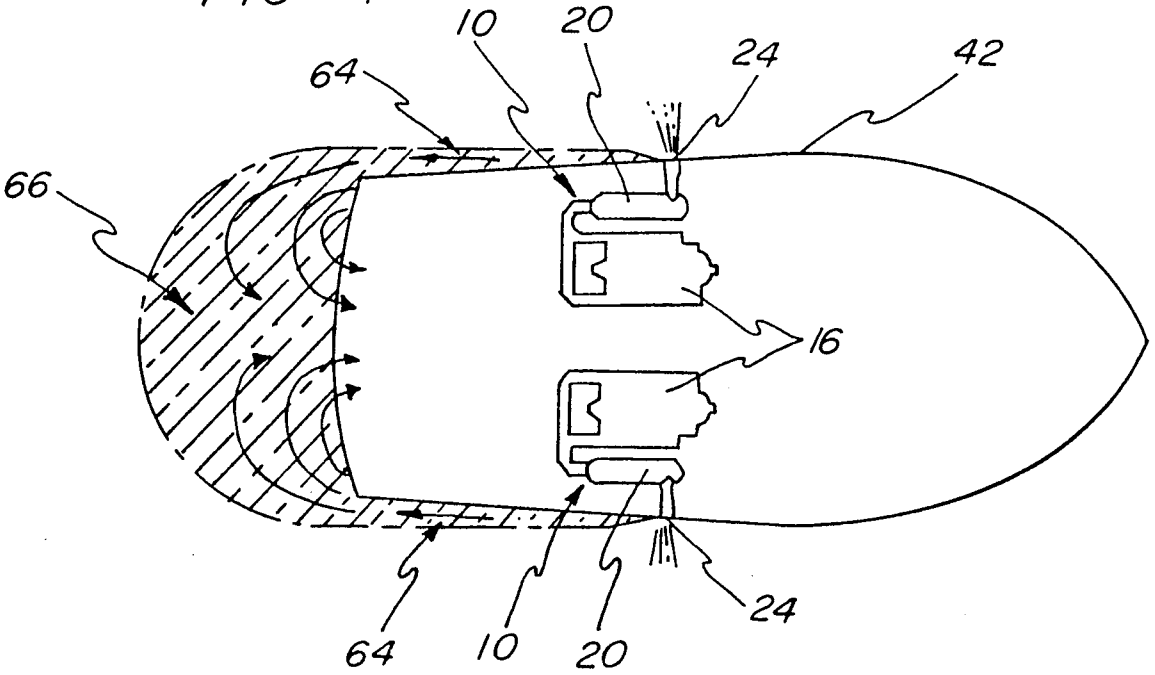
FIG. 4 is a top view showing the relative placement of the exhaust system and engine to a boat hull.

As can be seen in FIG. 4, the exhaust assembly 20 containing the first and second chambers 18, 22 preferably extends within the engine compartment alongside and outboard of the engine 16 to facilitate locating the nozzle 24 amidship on the hull 42. Placing the exhaust system 10 entirely within the engine compartment also results in more usable storage space being available in the area behind the engine compartment of the boat, since the exhaust system 10 is no longer routed through this area. In addition, by placing the exhaust system 10 within the engine compartment, the exhaust noise is further abated by the soundproofing already present in the compartment for reducing the engine noise.

By locating the nozzle 24 amidship on the hull 42, the exhaust gases are expelled at approximately the widest part of the boat, which is forward of the thicker turbulent boundary layer of air 64 along the hull side. Thus, the gases are discharged at a point ahead of the troublesome low pressure areas 66 which follow the boat.

Figure 5:
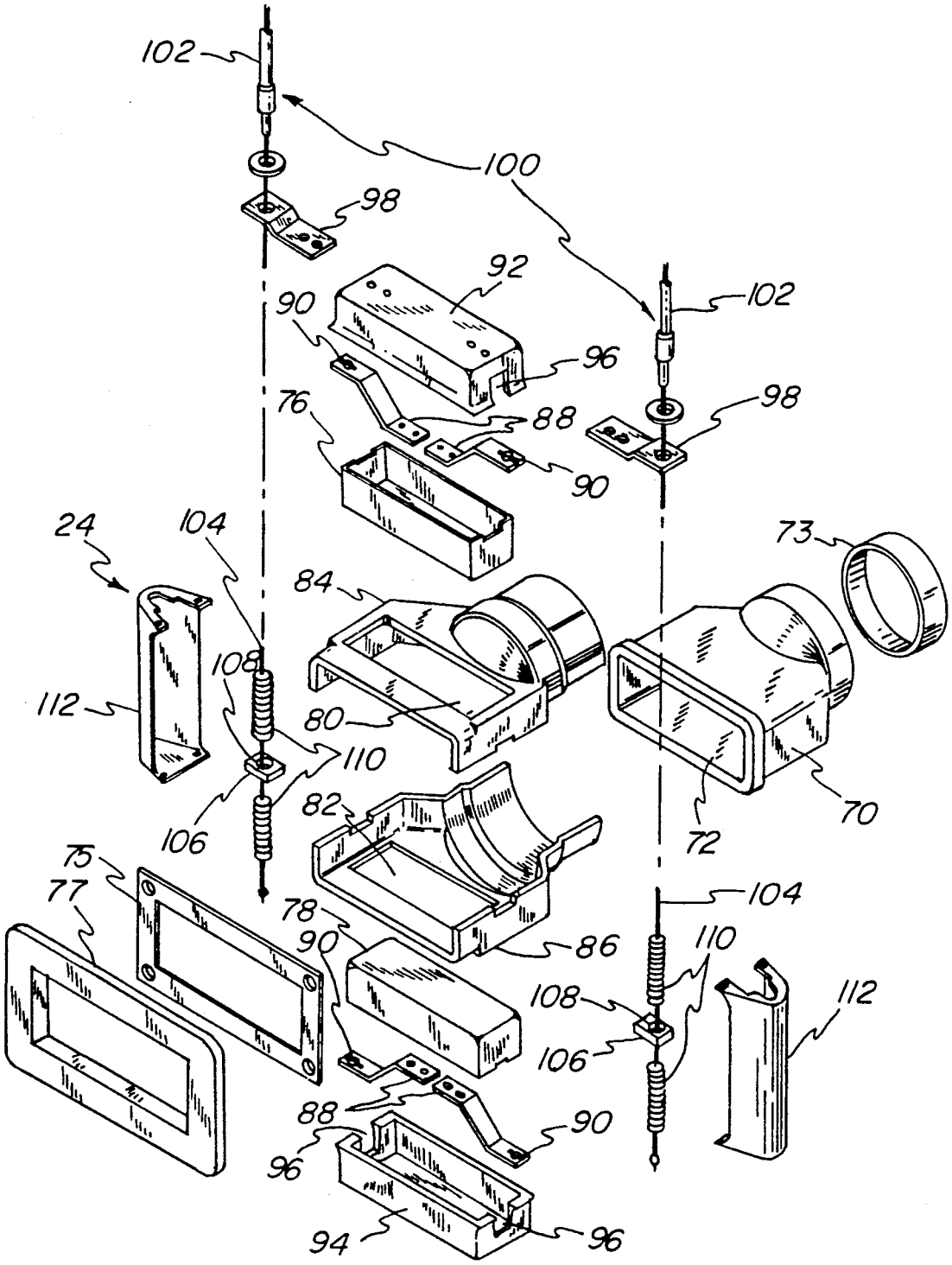
FIG. 5 is an exploded view of the nozzle of the present invention.
Figure 6:
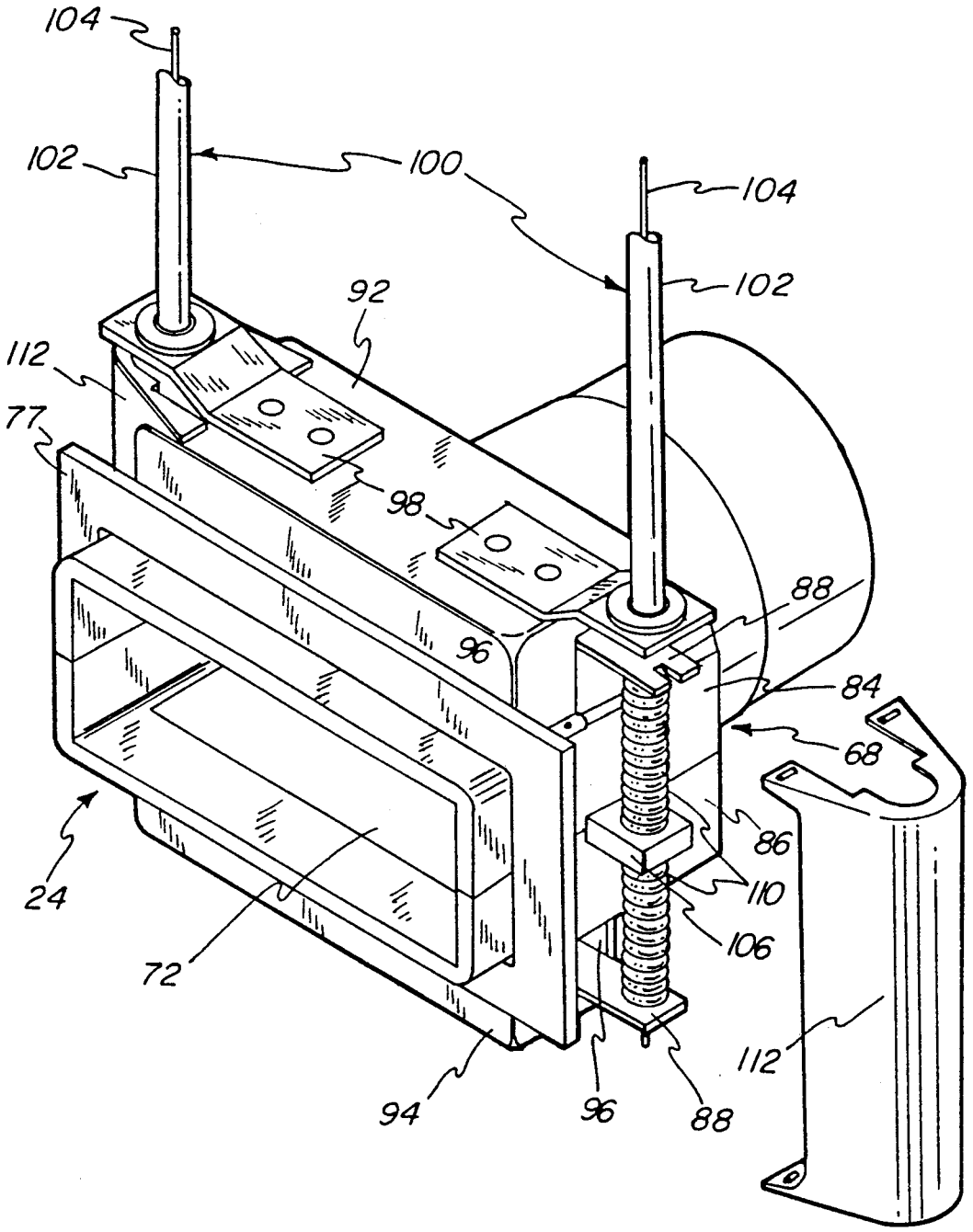
FIG. 6 is a perspective view of the nozzle with one of the spring covers removed.

Referring to FIGS. 5 and 6, the nozzle 24 is constructed such that the outlet area can be continuously varied between a plurality of positions depending upon the engine speed and the amount of back pressure within the system 10. The nozzle 24 includes a nozzle body 68 within which is located a flexible orifice means 70 which may be formed of a suitable flexible elastic material such as neoprene and which defines an opening 72 forming the nozzle outlet area. A retaining ring 73 is provided for holding the orifice means 70 in place within the nozzle body 68. In addition, a fastening plate 75 and face plate 77 are provided for attaching the nozzle body 68 to the hull 42 of the boat.

Control means 26 act on the outer surface of the flexible orifice means 70 to vary the outlet area of the nozzle 24. The orifice means 70 may be formed as a flexible sleeve which can be stretched slightly as the control means 26 act upon it to decrease the outlet area of the nozzle 24. The orifice means 70 may alternatively be constructed with accordion shaped folds along upper and lower portions of the orifice means 70 such that the orifice means 70 need not be stretched as the nozzle outlet area is decreased.

The control means 26 include upper and lower generally rectangularly shaped pistons 76, 78 which pass through apertures 80, 82 formed in top and bottom portions 84, 86 of the nozzle body 68 to contact the orifice means 70. Cable anchors 88, having means defining a hole 90 therethrough, extend from either side of each of the pistons 76, 78 and a piston cover 92, 94 is juxtaposed over each of the pistons 76, 78 and attached to the nozzle body 68. A slot 96 for receiving the cable anchors 88 is formed in opposing sides of each of the piston covers 92, 94 to allow vertical movement of the pistons 76, 78 and cable anchors 88, and cable guides 98 are mounted to either side of an upper one of the piston covers 92, 94.

The control means 26 further includes a pair of control cable assemblies 100, each including a cable cover 102 and a control cable 104 within the cable cover 102. The cable covers 102 are attached to the cable anchors 88, at the holes 90 therein, on either side of one of the pistons 76, and an end of each of the control cables 104 is attached to the cable anchors 88, at the holes 90 therein, on the other of the pistons 78. Thus, the control cable assemblies 100 act to draw the pistons 76, 78 toward one another to close off the opening 72 formed by the flexible orifice means 70 and reduce the outlet area of the nozzle 24.

A pair of spring seats 106 is attached to the nozzle body 68 intermediate the top and bottom sides 84, 86, with each seat 106 having means defining a hole 108 therethrough. The control cables 104 on the sides of the nozzle body 68 pass through the holes 108 in the spring seats 106. A pair of springs 110 is positioned over each of the control cables 104 with one of each of the springs 110 located between a spring seat 106 and a cable anchor 88 such that the springs 110 act to bias the pistons 76, 78 apart when the control cables 104 are not actuated to move the pistons 76, 78 toward one another. In addition, if it is necessary to disconnect the nozzle 24 from the system of controls 26 for any reason, the cables 104 can be quickly disconnected and the springs 110 will force the nozzle 24 to assume a fully open position. A pair of spring covers 112 are provided in either side of the nozzle 24 for covering the springs 110 and the cable anchors 88 along each side of the nozzle body 68.

Figure 3:
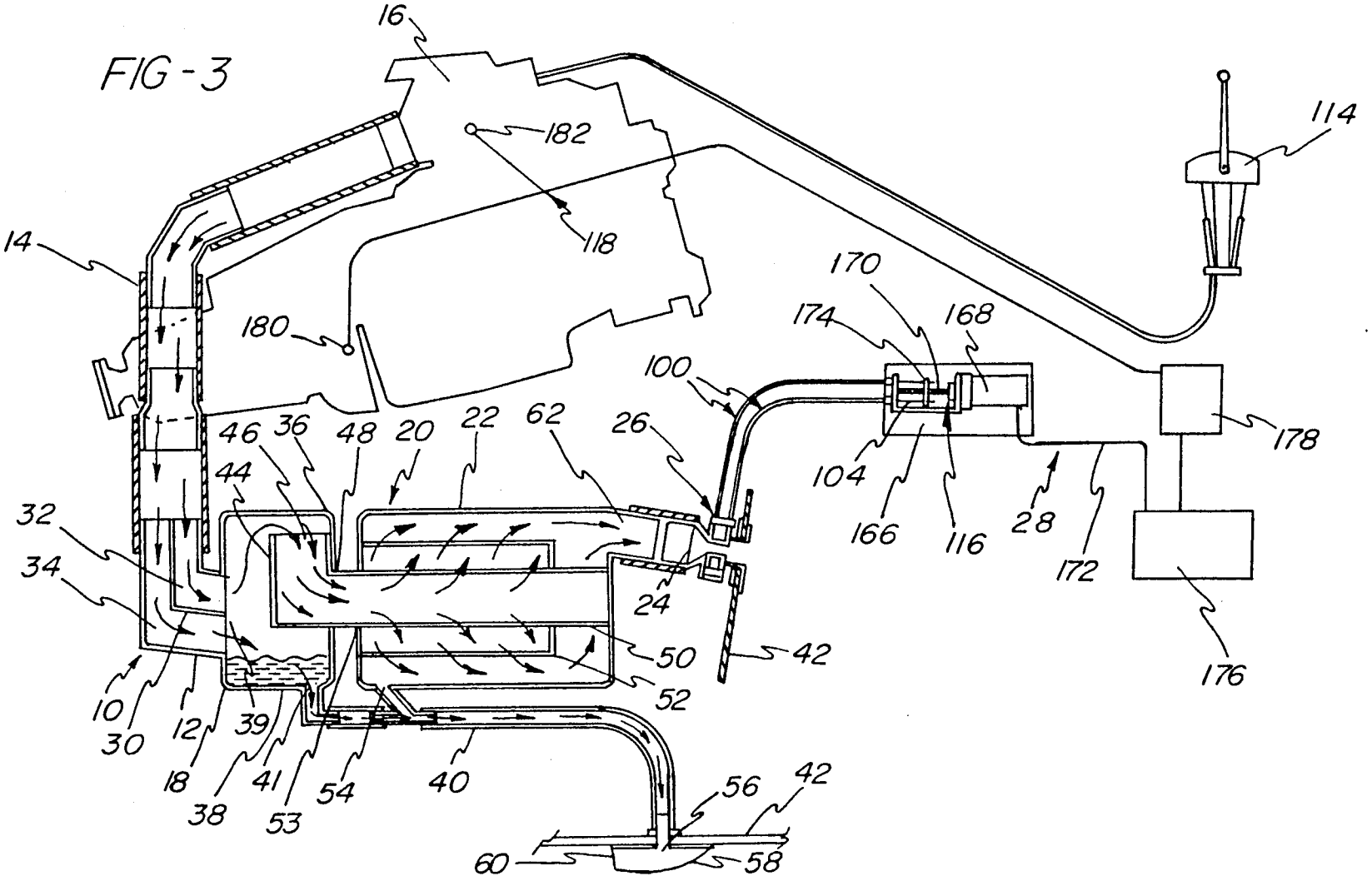
FIG. 3 is a schematic of the present exhaust system showing an electromechanical actuator.

Referring to FIGS. 1 and 3, actuator means 28 are provided remote from the nozzle 24 to actuate the control cable 104 and selectively position the control means 26 with reference to a desired exhaust system pressure. The actuator and control means 28, 26 act to reduce the nozzle outlet area during low engine speeds and thus increase the exhaust system pressure such that the distance that the gases are expelled from the nozzle 24 is increased in order to penetrate the turbulent boundary layer of air 64 surrounding the hull 42 of the boat when the boat is in motion. The actuator and control means 28, 26 also act to increase the nozzle outlet area at higher engine speeds and thus prevent excessive pressure from building up within the exhaust system 10.

The actuator means 28 may either be in the form of a mechanical linkage which is connected to a throttle control 114 for the engine to the control means 26, as illustrated in FIG. 1, or in the form of an electromechanical drive and sensing means where an electromechanical drive 116 moves the control means 26 in response to input signals generated by sensing means 118, as illustrated in FIG. 3. The sensing means 118 of the electromechanical drive system being positioned to sense the speed of the engine 16 and the pressure in the exhaust system 10.

Figure 2:
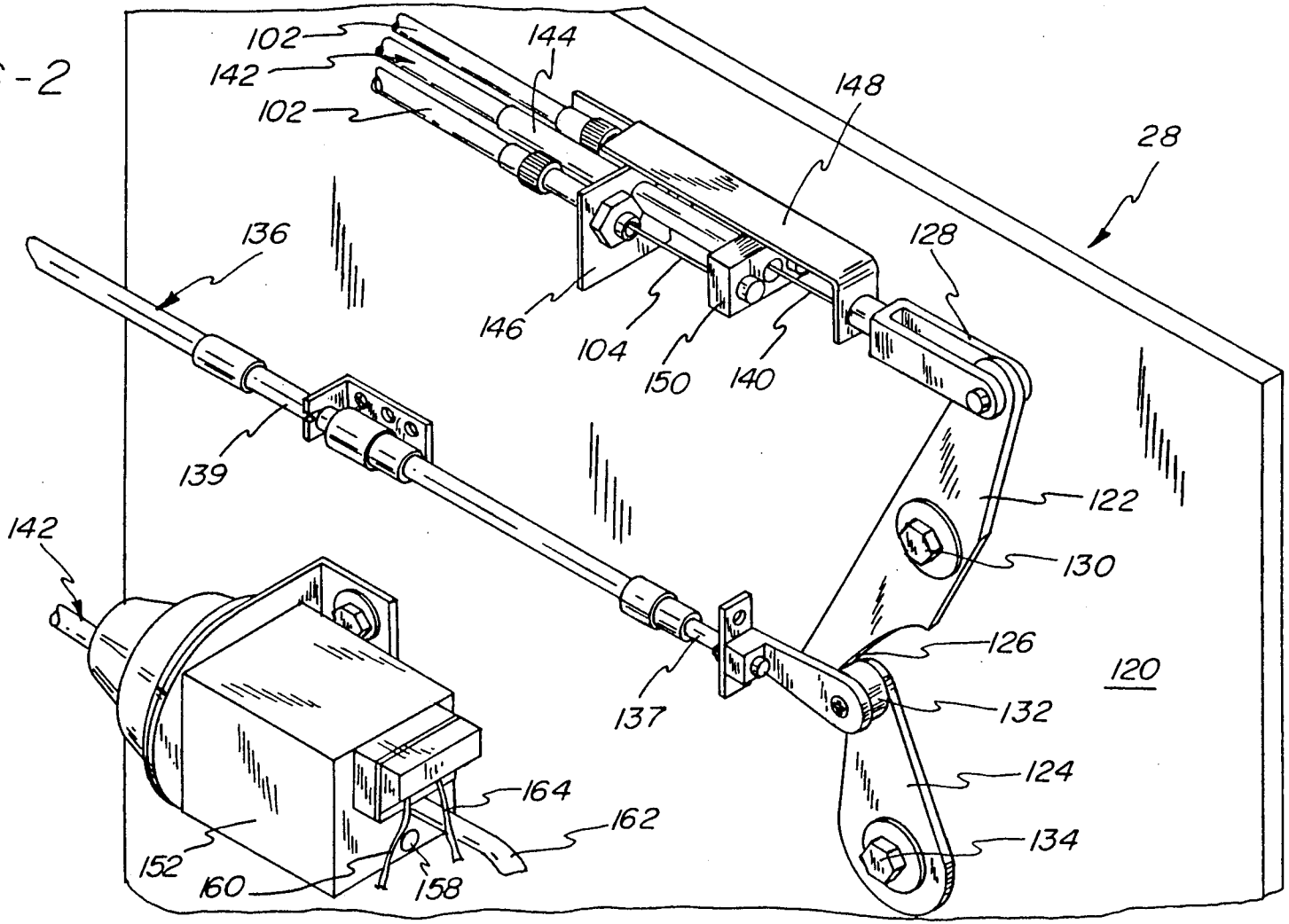
FIG. 2 is an enlarged view of the transfer panel for the mechanical linkage actuator.

The mechanical linkage actuator 28 of FIGS. 1 and 2 includes a transfer panel 120 having a cam lever 122 and a cam actuator 124 mounted thereto. The cam lever 122 includes a cam surface 126 located at one end thereof and a clevis 128 attached to an opposite end. The cam lever 122 is further provided with a pin 130 between its ends whereby the lever 122 is pivotally mounted to the transfer panel 120. A cam roller 132 is attached to one end of the cam actuator 124 and a pivot pin 134 is located at an opposite end for pivotally mounting the cam actuator 124, whereby the cam roller 132 is positioned for engagement with the cam surface 126.

An actuator control cable assembly 136 extends from a connection point 138 where an actuator control cable 137 may be connected to a portion of the throttle control system for the engine such as the throttle control linkage for the carburetor. Alternatively, the actuator control cable 137 could be attached directly to the throttle control 114. A ferrule portion 139 of the other end of the actuator control cable assembly 136 is rigidly mounted to the transfer panel 120 and the actuator control cable 137 is attached to the cam actuator 124 at the location of the cam roller 132 such that movement of the throttle control 114 results in movement of the cam actuator 124 which in turn causes the cam lever 122 to move about its pivot pin 130.

The clevis 128 mounted at the end of the cam lever 122 is connected to a cable portion 140 of a connecting means cable assembly 142 and a ferrule 144 of the connecting means cable assembly 142 is slidably mounted in an anchor bracket 146 attached to the transfer panel 120. The clevis 128 is further provided with a guide 148 which extends toward and engages the anchor bracket 146 in sliding contact to maintain the alignment between the clevis 128 and the ferrule 144 as they move relative to the anchor bracket 146.

The cable covers 102 of the control cable assemblies 100 are immovably attached to the anchor bracket 146, and the control cables 104 are connected to an equalizer bar 150 which is rigidly mounted across the end of the ferrule 144. Thus, when the connecting means cable 140 is actuated, the ferrule 144 and the clevis 128 are drawn toward one another such that the equalizer bar 150 is held stationary relative to the clevis 128 whereby movement of the cam lever 122 results in movement of the control cables 104 to vary the nozzle outlet area.

The connecting means cable assembly 142 is connected to a connecting means actuator 152 which acts to draw the cable 140 toward it in order to activate the clevis 128 and equalizer bar 150 for movement of the control cables 104. As can be seen in FIG. 2A, the connecting means actuator 152 includes a vent valve 154 and a charge valve 156. The vent valve 154 is normally in an open position which permits the interior of the connecting means actuator 152 to be in fluid communication with the exterior through an outlet passage 158. An electrical line 160 from the ignition system for the engine energizes the vent valve 154 to close the passage 158 when the ignition is on.

The charge valve 156 is normally in a closed position and includes an inlet passage 162 and an electrical line 164 connected to a neutral safety switch associated with a control lever for controlling the transfer of power from the engine to the screw of the boat, such as a clutch lever or a reverse gear lever, such that the line 164 will be energized when the screw is engaged to propel the boat. The inlet passage 162 is connected to the intake manifold of the engine whereby a vacuum charge is provided, in the case of a gasoline engine being used, for activating the connecting means actuator 152.

Thus, the connecting means actuator 152 will be activated when the ignition is turned on to activate the vent valve 154 and close passage 158, and the clutch is engaged to open charge valve 156 such that a vacuum charge is applied to the connecting means actuator 152. Upon actuating the connecting means actuator 152, the connecting means cable 140 is drawn into the connecting means actuator 152 such that the equalizer bar 150 is drawn into contact with the clevis 128 and the control cables 104 will move in response to movements of the cam lever 122.

The above valve arrangement for the connecting means actuator 152 permits the nozzle 24 to remain in a fully open position during engine shutdown such that the flexible orifice means 70 may remain in a relaxed condition when it is not in use and thereby extend its useful life. In addition, by permitting the nozzle to remain in a fully open position until the clutch is engaged, provision is made for permitting the engine to warm up with a minimum of back pressure as well permitting the throttle to be "pumped" or moved back and forth without increasing the back pressure during engine start-up.

It should be noted that once the connecting means actuator 152 is activated, it will remain in an activated condition as long as the ignition line 160 remains energized even if the charge valve 156 is closed as a result of the clutch being disengaged and the line 164 being deenergized. This is because any charge supplied to the connecting means actuator 152 will remain in the connecting means actuator 152 until it is released through the outlet passage 158, such as will occur upon the engine being turned off.

Further, the above system for actuating the clevis 128 may be used with engines in which no source of vacuum is available, such as is the case when a diesel engine is used. In this case, a connecting means actuator 152 may be provided which operates in response to a pressurized charge wherein the pressurized charge is provided from the pressurized air supplied to the intake manifold of the engine.

The cam surface 126 on the cam lever 122 is designed such that the movement of the nozzle orifice 70 will be non-linear relative to the movement of the throttle control 114. Thus, when the connecting means actuator 152 is activated to draw the equalizer bar 150 into engagement with the clevis, movement of the throttle control 114 through the first two-thirds of its travel will result in the nozzle orifice 70 undergoing only approximately one-quarter of its total movement toward the open position, and movement of the throttle control 114 through the final third of its travel will result in the nozzle orifice 70 moving through the final three-quarters of its travel to full open position.

The electromechanical drive actuator means 28 of FIG. 3 includes a transfer panel 166 having a stepping motor 168 which has an output shaft 170 and an input line 172. The output shaft 170 of the stepping motor 168 is threaded to engage a threaded aperture in a plate 174 which is connected to the nozzle control cables 104. Thus, rotation of the stepping motor shaft 170 results movement of the plate 174 along the motor shaft 170 and consequently in controlled movement of the control cables 104. The direction and extent of rotation of the motor output shaft 170 is controlled by a bi-directional motor control 176 which is connected to the motor 168 through the input line 172 and which receives control signals from a microprocessor 178. The microprocessor 178 in turn receives signals from a speed sensor 180 and a pressure sensor 182 located on the engine 16 and within the exhaust system 10, respectively.

Figure 8:
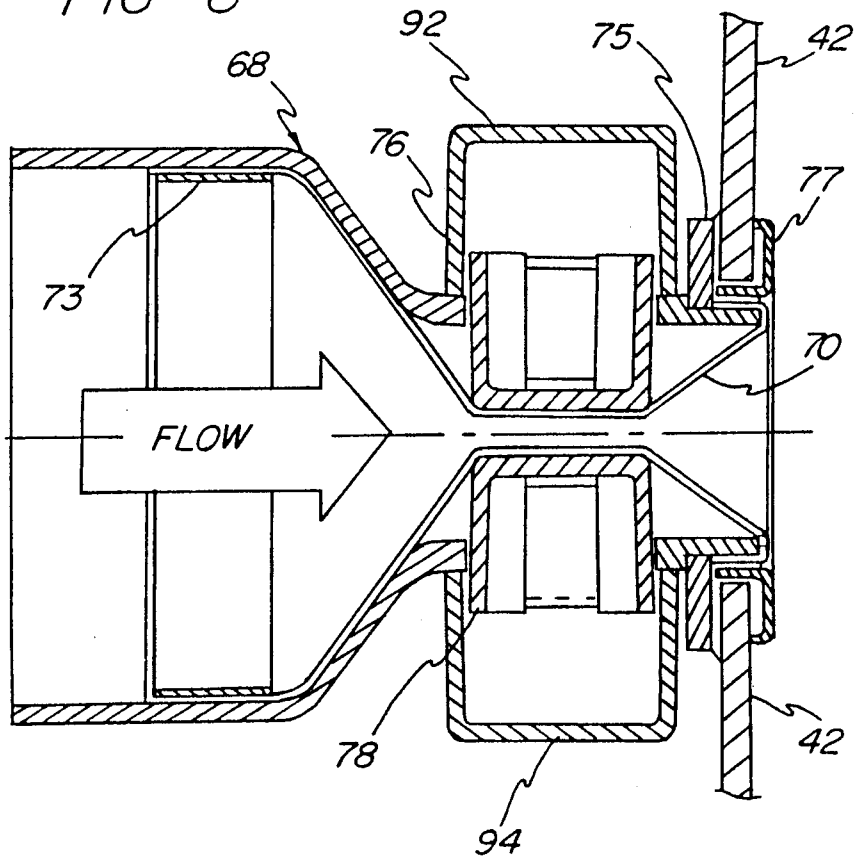
FIG. 8 is an elevational cut-away view of the nozzle in the fully closed position.
Figure 7:
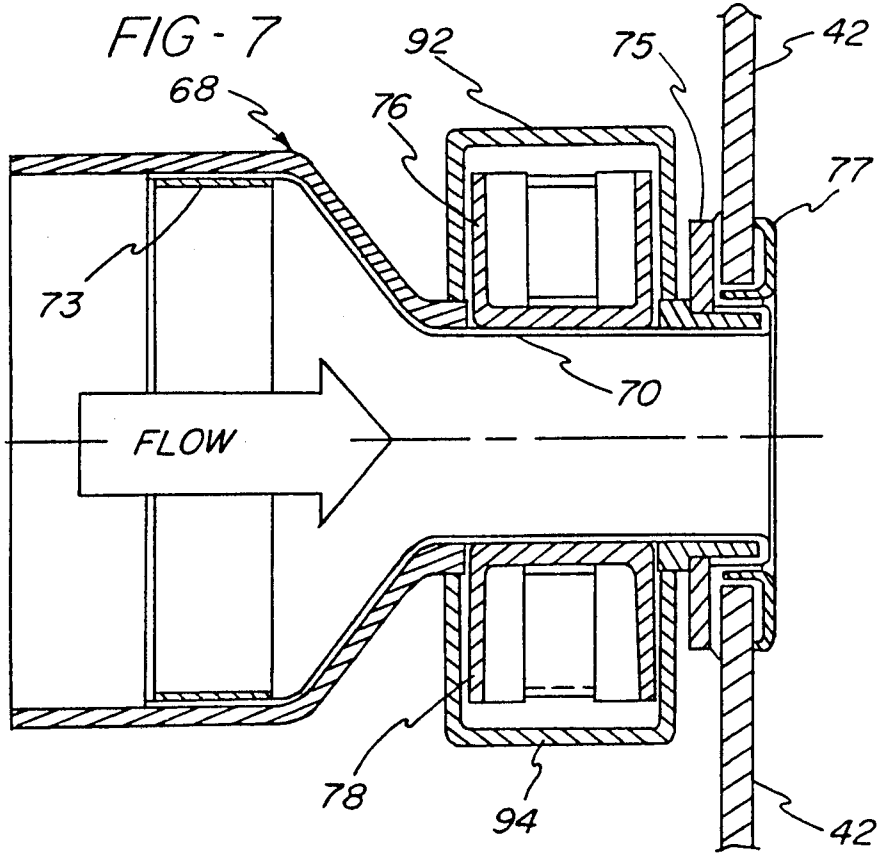
FIG. 7 is an elevational cut-away view of the nozzle in the fully open position.

Thus, the nozzle outlet area may be controlled with direct reference to the engine speed and the exhaust system pressure, such that the nozzle area may be increased at high engine speeds or when excessive pressure is sensed, or the nozzle area may be decreased as the engine speed decreases or the exhaust system pressure is decreased. This is illustrated in FIGS. 7 and 8, in which FIG. 7 shows the position of the nozzle in the fully open position and FIG. 8 shows the position of the nozzle in the fully closed position. Further, the microprocessor 178 may be programmed to control the movement of the control cables 104 such that the nozzle orifice 70 closes in a non-linear relationship to the engine speed in a manner similar to that described for the embodiment shown in FIG. 1.

As an additional benefit of using a nozzle 24 having a variable outlet area, the area through which the exhaust noises pass is kept to a minimum for any given engine speed. Thus, the variable nozzle 24 also acts as a means of reducing exhaust noise passing out through the exhaust system 10.

As is apparent from the above description, the present marine exhaust system provides an effective and efficient means for projecting exhaust gases to a point outside of the turbulent boundary layer surrounding the hull of a boat in motion. This is accomplished by varying the nozzle outlet area to maintain a pressure within the exhaust system which is equal to or less than the pressure recommended by the engine manufacturer. Thus, a maximum pressure within the system is maintained for projecting the gases a maximum distance from the boat at all engine and boat speeds.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A marine exhaust system comprising:

an exhaust assembly having a first and second chamber;

said first chamber forming a water separation compartment and having a top and bottom wall, an exhaust entrance located between said walls for permitting entry of a gas/water mixture to be separated, a gas exit located adjacent said top wall, a water exit located in said bottom wall, and a water discharge pipe for conveying water directly from said first chamber at said water exit;

said second chamber forming an acoustical chamber for reducing exhaust noises and including an inlet and a gas exit, said inlet being connected to said gas exit of said first chamber, sound baffling means through which gases entering said second chamber at said inlet pass, a water exit for conveying condensed water from said second chamber, said second chamber water exit being connected to said discharge pipe, said gas exit being located above said second chamber water exit; and a nozzle connected to said second chamber gas exit, said nozzle having a variable outlet area.

2. The exhaust system of claim 1, wherein said sound baffling means comprises a plurality of perforated tubes.

3. The exhaust system of claim 2, wherein said plurality of perforated tubes are positioned concentric to one another with a central one of said tubes positioned for receiving said gases as they enter said second chamber at said inlet.

4. The exhaust system of claim 1, wherein said gas exit in said first chamber is formed by a vertical tube having an upper end adjacent said top wall and a lower end connected to means defining an exit opening in said first chamber between said top and bottom walls.

5. The exhaust system of claim 4, including an expansion pipe connected to said exhaust entrance of said first chamber, said expansion pipe having a substantially horizontal baffle therein to define a lower passage for water and an upper passage for gas to provide an initial separation of said gas/water mixture before it enters said first chamber.

6. The exhaust system of claim 1, further comprising control means for varying the outlet area of said nozzle.

7. The exhaust system of claim 6, further comprising actuator means remote from said nozzle for actuating said control means to vary said nozzle outlet area with reference to a desired exhaust system pressure.

8. The exhaust system of claim 7, wherein said nozzle includes a nozzle body and a flexible orifice located within said nozzle body, said flexible orifice defining an opening forming said nozzle outlet area.

9. The exhaust system of claim 8, wherein said control means act on said flexible orifice to vary said nozzle outlet area.

10. The exhaust system of claim 9, wherein said control means include a pair of pistons in contact with said flexible orifice and movable toward and away from each other to vary the nozzle outlet area, and control line means acting between said actuator means and said pistons for moving said pistons.

11. The exhaust system of claim 7, wherein said actuator means comprises a transfer panel, a cam lever, a pivot pin for attaching said cam lever to said transfer panel intermediate the ends of said cam lever, a cam surface formed in one end of said cam lever, a cam actuator mounted to said transfer panel for pivotal movement, a cam roller attached to said cam actuator and positioned for engaging said cam surface as said cam actuator pivots, an actuator control cable attached at one end to said cam actuator at said cam roller and attached at the other end to a boat throttle control system, a clevis attached to an end of said cam lever opposite from said cam surface, control line means for connecting said actuator means to said control means, and means for connecting said control line means to said clevis such that said control line means move in response to movement of said clevis.

12. The exhaust system of claim 11, wherein said means for connecting said control line means to said clevis may be caused to selectively connect and disconnect said clevis and said control line such that said clevis may move independently of said control line when in a disconnected condition.

13. The exhaust system of claim 7, wherein control line means connect said actuator means to said control means and said actuator means comprises a transfer panel having a stepping motor having an output shaft and an input line, said output shaft being connected to said control line to control movement of said control line, said input line being connected to a motor control for controlling the direction and extent of rotation of said motor output shaft, a speed sensor for use in sensing the speed of an engine, a pressure sensor for sensing the pressure in said exhaust system, said motor control operating to control movement of said motor and said control line in response to outputs received from said speed and pressure sensors to vary the nozzle outlet area.

14. A marine exhaust system for use with an engine and a boat hull comprising:

an exhaust assembly having an inlet for receiving a gas/water mixture from said engine, means for separating exhaust gas from water, means for reducing exhaust noises, an exhaust gas outlet, and means separate from said exhaust gas outlet for conveying water from said exhaust assembly to a point exterior of said boat hull;

a nozzle having a variable outlet area connected to said exhaust gas outlet said nozzle positioned at said boat hull for expelling exhaust gases into the air surrounding said boat hull;

control means for varying the outlet area of said nozzle; and actuator means remote from said nozzle for actuating said control means to vary said nozzle area with reference to a desired exhaust system pressure.

15. The exhaust system of claim 14, wherein said hull includes a bottom portion and side portions, said nozzle being located at one of said side portions.

16. The exhaust system of claim 15 wherein said nozzle is located amidship on said hull.

17. The exhaust system of claim 15, wherein said nozzle area varies in relation to the speed of said engine to expel said exhaust gas a maximum distance for any engine speed such that said exhaust gas is expelled to a point outside of the turbulent boundary layer formed around said boat hull when said hull is moving.

18. The exhaust system of claim 15, wherein said means for conveying water from said exhaust assembly comprises a pipe with an outlet in said bottom portion of said hull, a scoop having an opening located on said hull over said pipe outlet and positioned with said opening directed toward the rear of said boat when said boat is moving in a forward direction such that a suction effect is created on said pipe.

19. The exhaust system of claim 14, wherein said actuator means is a mechanical linkage from a throttle control system for controlling the speed of said engine to said control means.

20. The exhaust system of claim 19, wherein said nozzle area varies in a non-linear relationship to movement of said throttle control system.

21. The exhaust system of claim 20, wherein said actuator means includes a transfer panel, a cam lever mounted for pivotal movement on said transfer panel, a cam actuator mounted for pivotal movement on said transfer panel and located for engagement with said cam lever, and control line means extending from said cam lever to said control means such that said control line means move in response to movement of said cam lever.

22. The exhaust system of claim 21, wherein said cam lever includes a cam surface and said cam actuator includes a cam roller for engaging said cam surface.

23. The exhaust system of claim 21, wherein connecting means are provided for connecting said cam lever and control line such that said control line moves with said cam lever and for disconnecting said cam lever and said control line such that said cam lever moves independently of said control line.

24. The exhaust system of claim 23, wherein said connecting means includes a connecting means cable assembly having a ferrule and attachment means for attaching said control line means to said ferrule and cable means running through said connecting means cable assembly and connected to said cam lever, said cable means acting to draw said attachment means towards said cam lever to cause said control line means to move with said cam lever.

25. The exhaust system of claim 24, wherein a connecting means actuator is provided for moving said cable means of said connecting means cable assembly, said connecting means actuator acting on said cable means such that said attachment means moves with said cam lever when said engine is operating and acting to allow said cam lever to move independently of said attachment means when said engine is not operating.

26. The exhaust system of claim 14, wherein said actuator means includes an electromechanical drive and sensing means, said electromechanical drive moving said control means in response to input signals generated by said sensing means.

27. The exhaust system of claim 26, wherein said sensing means are positioned to sense the speed of said engine and the pressure in said exhaust system.

28. A marine exhaust system in combination with an engine and a boat having a hull comprising:

an engine exhaust pipe;

an expansion pipe of larger diameter than said exhaust pipe with a substantially horizontal baffle extending through said expansion pipe to define a lower passage for water and an upper passage for gas to provide an initial separation of a gas/water mixture from said exhaust pipe;

an exhaust assembly having a first and a second chamber;

said first chamber forming a water separation compartment and having a top and a bottom wall, an entrance between said top and bottom walls connected to said expansion pipe for receiving said gas/water mixture, a vertical gas separation tube having an upper end adjacent said top wall for receiving gases and a lower end connected to a gas exit in a wall of said first chamber between said top and bottom walls, and a water exit connected to said bottom wall;

said second chamber forming an acoustical chamber for reducing exhaust noises, an inlet to a central portion of said second chamber connected to said first chamber gas exit, a substantially horizontal central perforated tube connected to said inlet and extending the length of said second chamber, said central tube being concentrically surrounded by at least one additional perforated tubes, a gas outlet located in an upper portion of said second chamber above said inlet, and a water exit located exteriorly of said perforated tubes and below said inlet and said outlet to remove condensed water from said second chamber;

a water discharge pipe connected to said first and second chamber water exits at one end and to an outlet at a submerged portion of said boat hull at the other end;

a scoop having an opening, said scoop located on said hull over said water discharge pipe outlet and positioned with said opening directed toward the rear of said boat when said boat is moving in a forward direction such that a suction effect is created on said water discharge pipe;

a nozzle connected to said gas outlet from said second chamber, said nozzle having a variable outlet area, and being located amidship on a side of said hull and including a nozzle body having top and bottom sides joined by vertical sides, a flexible orifice means located within said nozzle body, said flexible orifice means defining an opening forming said nozzle outlet area, and control means acting on said flexible orifice means to vary the outlet area of said nozzle;

said control means comprising generally rectangular block shaped upper and lower pistons, said nozzle body top and bottom sides each having means defining an aperture therein, said upper and lower pistons passing through said apertures to contact said flexible orifice means, a cable anchor having means defining a control cable hole therethrough attached to and extending from either side of each of said pistons, a piston cover juxtaposed over each of said pistons and attached to said nozzle body, a slot in opposing sides of each of said piston covers for receiving said cable anchors so as to allow vertical movement of said pistons and cable anchors, a pair of control cable assemblies each including a cable cover and a control cable, said cable covers being attached to said cable anchors on either side of one of said pistons, an end of each of said control cables being attached to said cable anchors on the other of said pistons, said control cable assemblies acting to control movement of said pistons toward one another, a pair of spring seats, each seat having means defining a hole therethrough and attached to said nozzle body intermediate said top and bottom sides, said control cable on either side of said nozzle body passing through said hole in said spring seat, a pair of springs positioned over each of said control cables with one of each of said springs located between said spring seat and each of said cable anchors, said springs acting to bias said pistons apart when said control cables are not actuated, a pair of spring covers for covering said springs and said cable anchors along each side of said nozzle body, and actuator means remote from said nozzle to actuate said control cable and selectively position said control means with reference to a desired exhaust system pressure, said actuator and control means acting to reduce the nozzle outlet area during low engine speeds and thus increase said exhaust system pressure such that the distance that said gases are expelled from said nozzle is increased in order to penetrate the turbulent boundary layer of air surrounding said hull when said boat is in motion, and said actuator and control means acting to increase the nozzle outlet area at higher engine speeds and thus prevent excessive pressure from building up within said exhaust system.

* * * * *